US012497871B2

(12) United States Patent
Boyd et al.

(10) Patent No.: US 12,497,871 B2
(45) **Date of Patent: *Dec. 16, 2025**

(54) CATCHER ASSEMBLY FOR A PLUNGER

(71) Applicant: FLOWCO PRODUCTION SOLUTIONS, LLC, Spring, TX (US)

(72) Inventors: Garrett S. Boyd, Granbury, TX (US); Mitchell A. Boyd, Haslet, TX (US); Darrell Mitchum, Oakhurst, TX (US)

(73) Assignee: Flowco MasterCo LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/815,511

(22) Filed: Aug. 26, 2024

(65) Prior Publication Data

US 2024/0418063 A1 Dec. 19, 2024

Related U.S. Application Data

(63) Continuation of application No. 18/508,696, filed on Nov. 14, 2023, now Pat. No. 12,071,836.

(60) Provisional application No. 63/425,231, filed on Nov. 14, 2022.

(51) Int. Cl.
*E21B 43/12* (2006.01)

(52) U.S. Cl.
CPC ..... *E21B 43/121* (2013.01)

(58) Field of Classification Search
CPC ..... E21B 43/121
See application file for complete search history.

(56) References Cited

U.S. PATENT DOCUMENTS 3,351,021 A * 11/1967 Moore, Jr. ..... E21B 43/121 417/57
4,120,353 A * 10/1978 Roesner ..... E21B 47/08 166/66.4
4,211,279 A * 7/1980 Isaacks ..... E21B 43/122 166/70
4,243,070 A * 1/1981 Jackson ..... F16K 17/0453 137/859
4,898,235 A * 2/1990 Enright ..... E21B 43/121 166/105
4,986,727 A * 1/1991 Blanton ..... F04B 47/12 417/58
5,253,713 A * 10/1993 Gregg ..... E21B 43/121 166/70
5,478,128 A * 12/1995 Aaland ..... E21B 11/005 294/50.8
5,518,372 A * 5/1996 Chin ..... F04B 17/046 417/415
6,467,541 B1 * 10/2002 Wells ..... F04B 47/12 166/372
7,040,401 B1 * 5/2006 McCannon ..... E21B 43/121 166/70

(Continued)

*Primary Examiner* — Steven A Macdonald
(74) *Attorney, Agent, or Firm* — Jason P. Mueller; FisherBroyles, LLP

(57) ABSTRACT

An electrically operated catcher mechanism that is part of a lubricator and catcher unit used in conjunction with a bypass plunger in an oil or gas well include an electrically operated mechanism to move between the catch and release positions. The electrically operated catcher mechanism includes a cam rotated by a motor which causes the device to move between catch and release positions.

16 Claims, 13 Drawing Sheets

(56) References Cited

U.S. PATENT DOCUMENTS 9,695,680 B2 * 7/2017 Bergman ..... F04B 47/12
9,915,133 B2 * 3/2018 Boyd ..... E21B 43/121
12,071,836 B2 * 8/2024 Boyd ..... E21B 43/121
2001/0051019 A1 * 12/2001 Bailey ..... G02B 6/29395 385/24
2002/0042701 A1 * 4/2002 Dancu ..... G09B 23/28 703/11
2004/0086638 A1 * 5/2004 Aschenbeck ..... D21J 1/20 427/180
2005/0022994 A1 * 2/2005 Wilson ..... E21B 27/02 166/305.1
2005/0230120 A1 * 10/2005 Victor ..... F04B 47/00 166/372
2006/0108126 A1 * 5/2006 Horn ..... F04B 47/12 166/105
2006/0167334 A1 * 7/2006 Anstadt ..... A61M 60/191 600/17
2006/0185902 A1 * 8/2006 Song ..... E21B 7/06 175/73
2008/0023203 A1 * 1/2008 Steiner ..... E21B 43/25 166/105
2011/0118882 A1 * 5/2011 Carlson ..... G06Q 10/06 700/282
2012/0080198 A1 * 4/2012 Lembcke ..... E21B 43/13 166/372
2015/0000761 A1 * 1/2015 Jefferies ..... E21B 34/08 137/554
2015/0136389 A1 * 5/2015 Bergman ..... F04B 47/12 166/250.15
2015/0176377 A1 * 6/2015 Agarwal ..... E21B 17/07 166/372
2016/0000999 A1 * 1/2016 Focht ..... F04B 7/06 604/151
2016/0090827 A1 * 3/2016 Agarwal ..... E21B 43/13 166/311
2016/0102533 A1 * 4/2016 Maerz ..... E21B 33/03 166/250.01
2017/0044881 A1 * 2/2017 Lynch ..... E21B 33/03
2017/0058651 A1 * 3/2017 Damiano ..... F04B 47/12
2017/0107803 A1 * 4/2017 Cedillo ..... E21B 43/13
2017/0122084 A1 * 5/2017 Brewer ..... E21B 43/121
2017/0152720 A1 * 6/2017 Greenwood ..... E21B 28/00
2017/0167474 A1 * 6/2017 Cannata ..... F04B 9/042
2018/0038666 A1 * 2/2018 Angle ..... F41C 23/16
2018/0100381 A1 * 4/2018 Agarwal ..... E21B 33/068
2020/0116303 A1 * 4/2020 Roberts ..... F04B 47/12
2022/0290499 A1 * 9/2022 Geldenhuys ..... F16N 7/14
2023/0008526 A1 * 1/2023 Sutherland ..... F16B 39/04
2023/0383630 A1 * 11/2023 Thorpe ..... E21B 43/122
2024/0159129 A1 * 5/2024 Boyd ..... E21B 43/121
2024/0328278 A1 * 10/2024 Roycroft ..... E21B 33/068
2024/0418063 A1 * 12/2024 Boyd ..... E21B 43/121

* cited by examiner

CATCHER ASSEMBLY FOR A PLUNGER

This application is a continuation of U.S. application Ser. No. 18/508,696, filed Nov. 14, 2023, which application claims the benefit of the filing date of U.S. Provisional Patent Application No. 63/425,231, filed Nov. 14, 2022. The contents of both applications are incorporated herein by reference.

BACKGROUND OF THE INVENTION

The present disclosure relates to a plunger catcher assembly for a lubricator that holds and releases a plunger used in oil and gas wells. The plunger catcher assembly includes an actuator that moves a catcher ball into a catching position at which the catcher ball can engage the exterior of a plunger to immobilize the plunger. The actuator also moves the catcher ball into a release position where the catcher ball disengages from the exterior of the plunger to release the plunger so that the plunger can descend into a well bore.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION OF THE INVENTION

The present disclosure is concerned with a catcher mechanism that is configured to hold and release a plunger used in oil and gas wells. But before turning to a description of the catcher mechanism itself, it is helpful to first describe a typical plunger and how it is used in connection with a well.

A plunger is a device that is configured to freely descend and ascend within a well bore, typically to restore production to a well having insufficient pressure to lift the fluids to the surface. Some embodiments are configured as a "bypass" plunger, which may include a self-contained valve—also called a "dart" or a "dart valve"—to control the descent and ascent. Typically the valve is opened to permit fluids in the well to flow through the valve and passages in the plunger body as the plunger descends through the well. Upon reaching the bottom of the well, the valve is closed, converting the plunger into a piston by blocking the passages that allow fluids to flow through the plunger. With the plunger converted to a piston, blocking the upward flow of fluids or gas, pressure in the fluid below the bypass plunger gradually increases until the pressure is sufficient to lift the plunger and the column of fluid in the well bore located above the bypass plunger to the surface. As fluid above the bypass plunger arrives at the surface, the fluid is passed through a conduit for recovery.

When the bypass plunger itself arrives at the surface, it is received in a lubricator mounted atop the well bore. A catcher mechanism on the lubricator catches and holds the bypass plunger. Upward movement of the bypass plunger into the held position brings a striker mechanism within the lubricator into engagement with the valve in the bypass plunger, moving the valve into the open position. At an appropriate time, the catcher mechanism releases the bypass plunger so that it can fall back to the bottom of the well bore to repeat the cycle.

Figure 1:
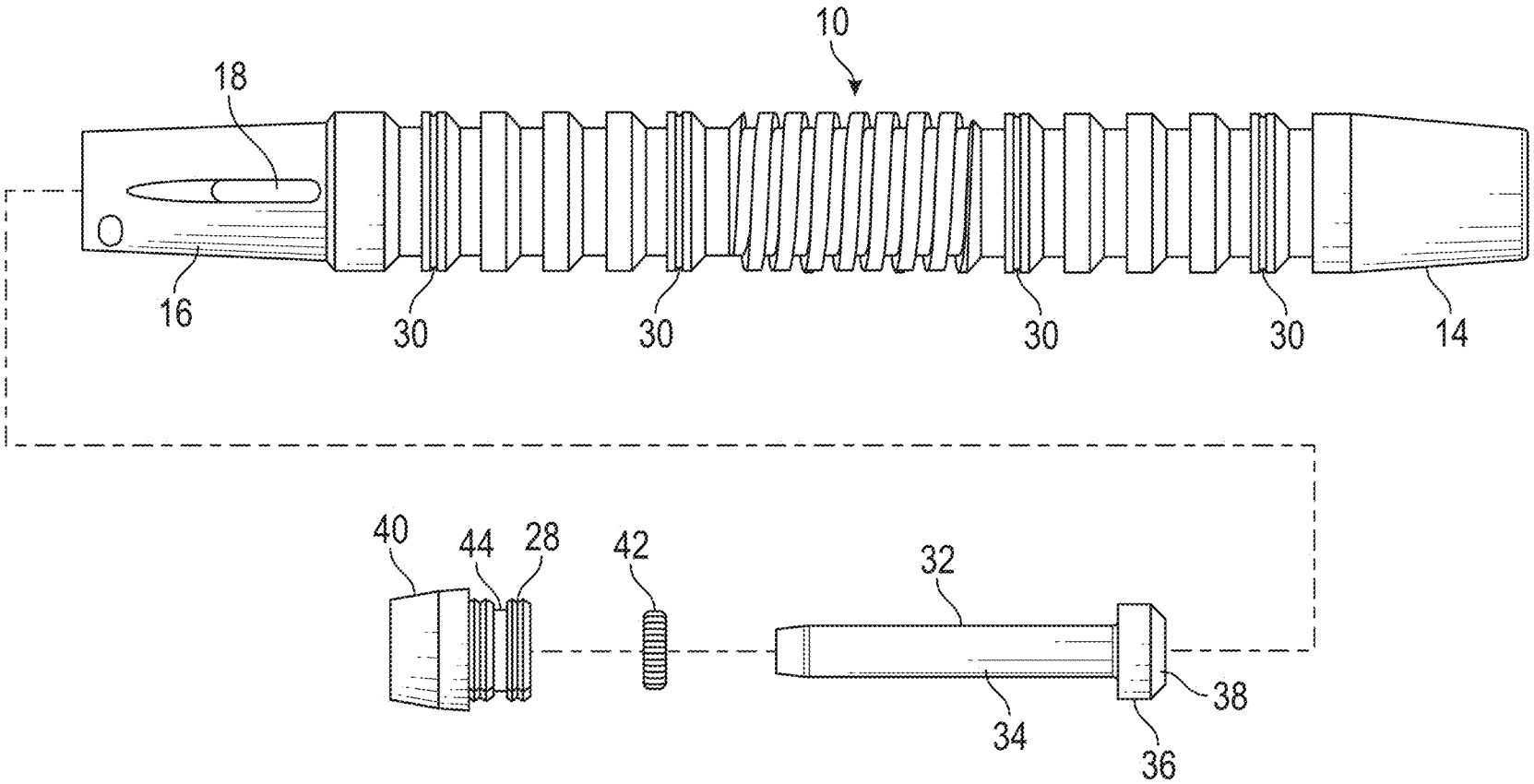
FIG. 1 is a partially exploded side view of a bypass plunger.
Figure 2:
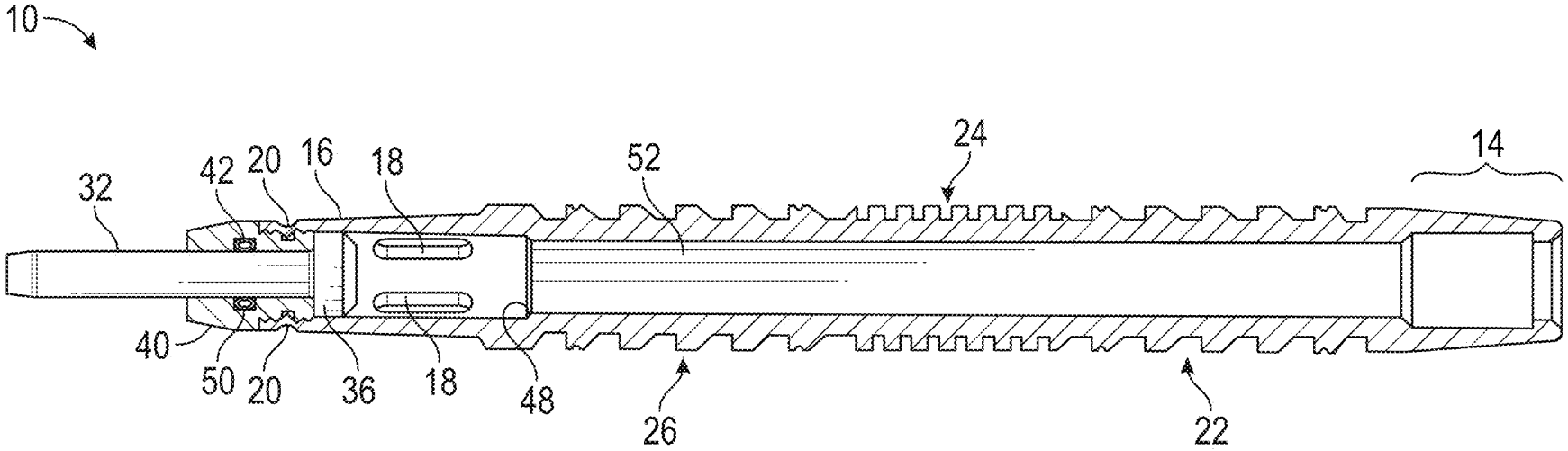
FIG. 2 is a cross-sectional view of the bypass plunger illustrated in FIG. 1 in an assembled state.

FIG. 1 illustrates a side exploded view of one embodiment of an integrated, unibody bypass plunger. FIG. 2 is a cross-sectional view of the bypass plunger. The unibody bypass plunger 10 is formed as a single hollow plunger body machined from a suitable material such as a stainless steel alloy. The plunger body includes a fishing neck 14, an upper section of scaling rings 22, an intermediate or central section of helical ridges or grooves 24, a lower section of scaling rings 26, and a valve cage 16 for enclosing and retaining a poppet valve or valve dart 32. The valve cage 16 includes a plurality of flow ports 18 disposed at typically two to four equally spaced radial locations around the valve cage 16. In the illustrated embodiment, two or more crimples 20 may be positioned as shown near the lower end of the hollow body 12/cage 16 unit. Each crimple 20 provides a mechanism to lock a retaining nut or end nut 40 threaded on the open, lower end of the valve cage 16. The hollow body 12 may further include wear grooves 30 disposed at selected ones of the sealing rings 22, 26 as shown. Further, disposed within the retaining or end nut 40 when the bypass plunger is assembled is a clutch 42 that holds the valve dart 32 in open and closed positions.

To assembly the bypass plunger, the valve dart 32 is inserted head-end first through the valve cage 16 into the lower end of the hollow body 12. The valve head 36 and its sealing face 38 form a poppet valve head at the end of stem 34. When installed in the hollow body 12, the sealing face 38 of the poppet valve or dart 32 is shaped to contact a valve seat 48 machined into the internal bore 52 of the hollow body 12. The valve dart 32 is retained within the valve cage 16 by an end nut 40 having external threads that mate with internal threads on the lower end of body. The end nut 40 includes an external circular groove 44 around part of its threaded portion. This groove 44 provides a relieved space so that a crimple 20 may extend into the groove 44 to lock the external threads of the end nut 40 to the corresponding internal threads on the lower end of the body. The end nut 40 also includes the clutch 42 resting in an internal circumferential groove 50.

Figure 3:
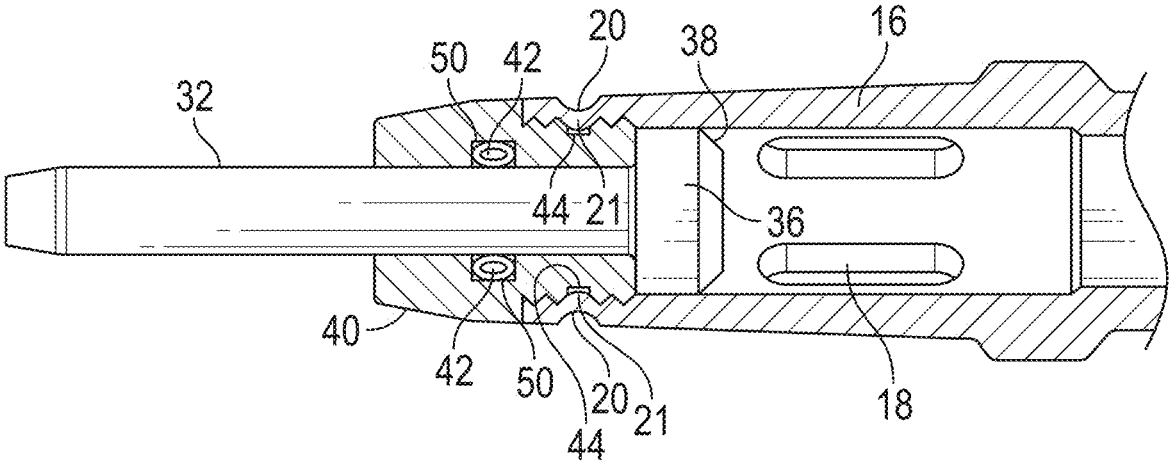
FIG. 3 is a partial cross-sectional view of the rear portion of the bypass plunger illustrated in FIGS. 1 and 2 where a valve dart is in the open position.

FIG. 3 illustrates a cross-sectional view of the lower end of the bypass plunger 10 shown in FIGS. 1 and 2 with the valve dart 32 in an open position. In the open position, the stem of the valve dart 32 protrudes outward from the bottom end of the bypass plunger. When the valve dart 32 is in the open position, fluid outside the bypass plunger can flow into the interior of the bypass plunger via the flow ports 18 in the valve cage 16. That fluid can then pass along the internal bore 52 of the plunger and exit through the neck 14. This allows a bypass plunger to descend to the bottom of a well bore that is filled with fluid.

Figure 4:
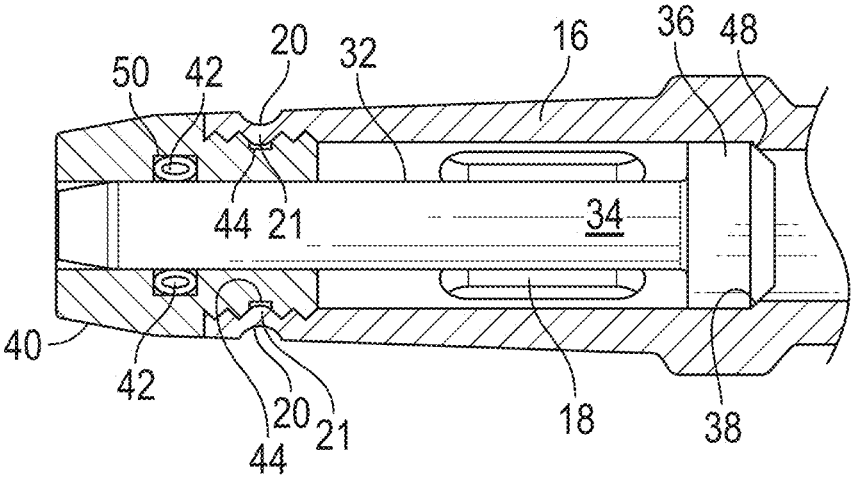
FIG. 4 is a partial cross-sectional view of the rear portion of the bypass plunger illustrated in FIGS. 1 and 2 where a valve dart is in the closed position.

When the bypass plunger hits the bottom of a well bore, the protruding end of the valve dart 32 contacts the bottom of the well bore, and further downward movement of the body of the bypass plunger serves to push the valve dart 32 into the closed position, as illustrated in FIG. 4. When the valve dart 32 is in the closed position, the sealing face 38 of the valve head 36 bears against a machined face 48 of the valve cage 16. As a result, fluid can no longer flow through the internal bore 52 of the bypass plunger 10. Pressure in the fluid beneath the valve head 36 only serves to press the valve head 36 more firmly into engagement with the machined face 48, holding the valve closed. As additional pressure builds up in the fluid below the bypass plunger, the pressure serves to push the bypass plunger 10 and the fluid above the bypass plunger toward the surface.

While the foregoing provides a description of a bypass plunger, not all plungers are bypass plungers. The technology disclosed herein can be used in conjunction with any type of plunger. Thus, the description of a bypass plunger should in no way be considered limiting.

Figure 5:
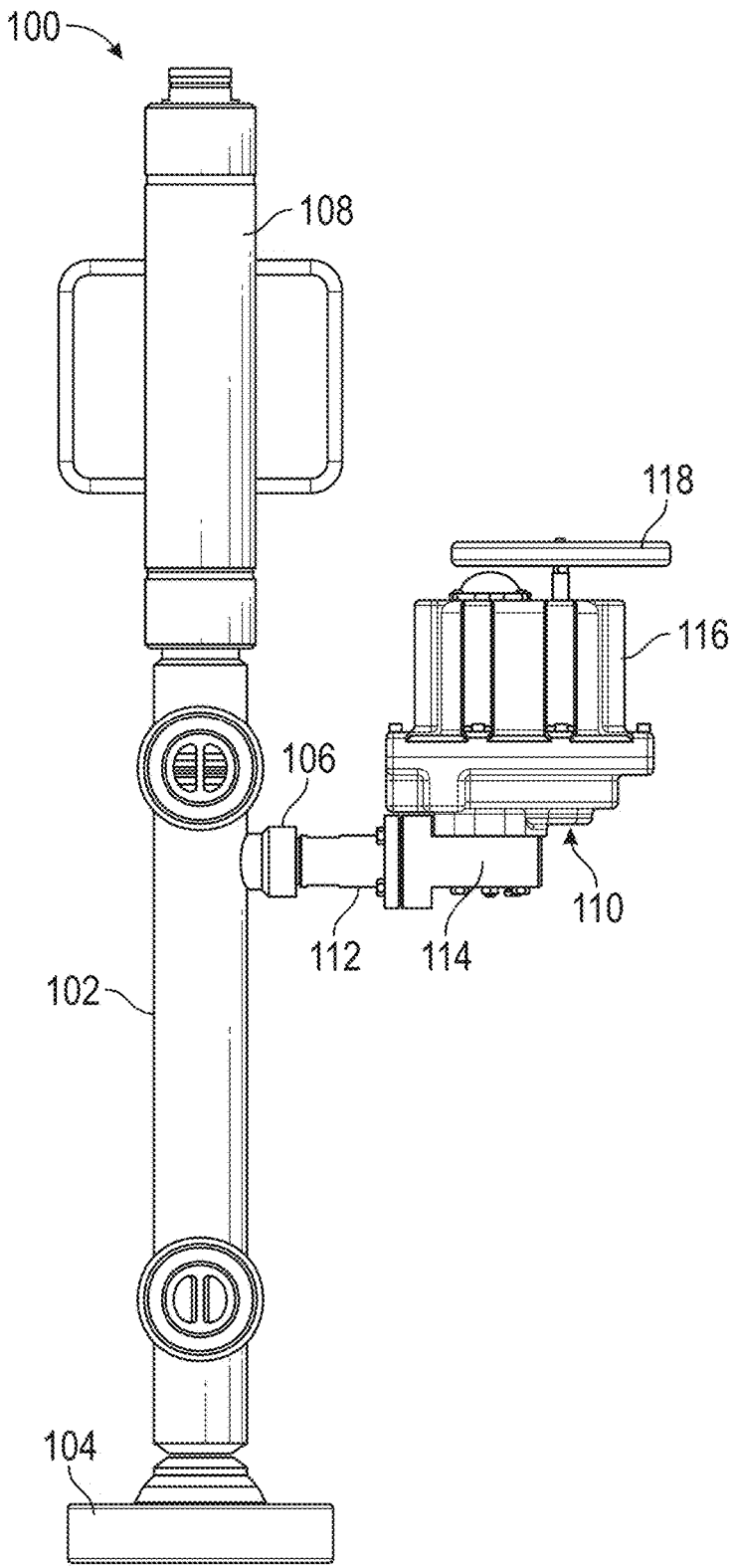
FIG. 5 is a front view of a lubricator and catcher unit that can be mounted on top of a well bore to receive and temporarily hold a bypass plunger.
Figure 6:
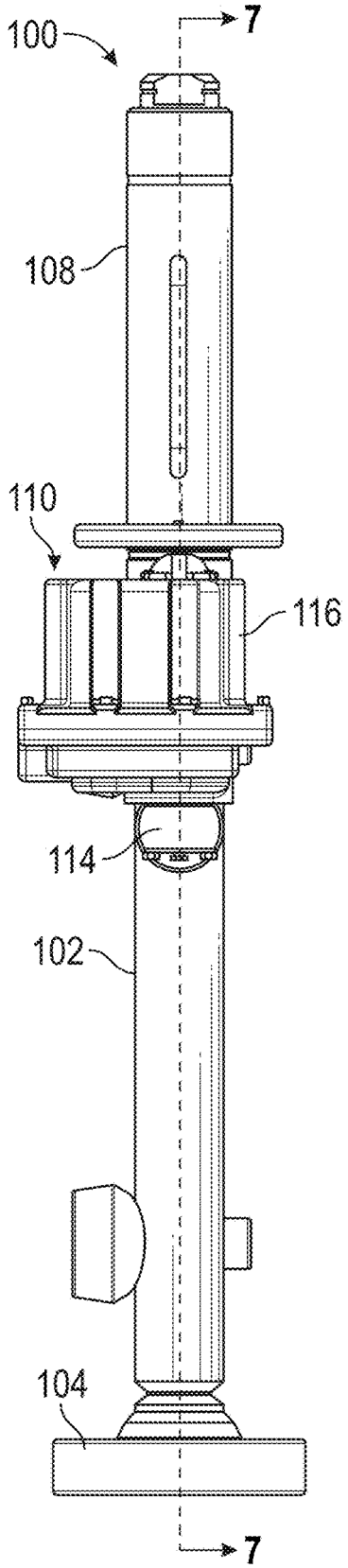
FIG. 6 is a side view of the lubricator and catcher unit illustrated in FIG. 5.
Figure 7:
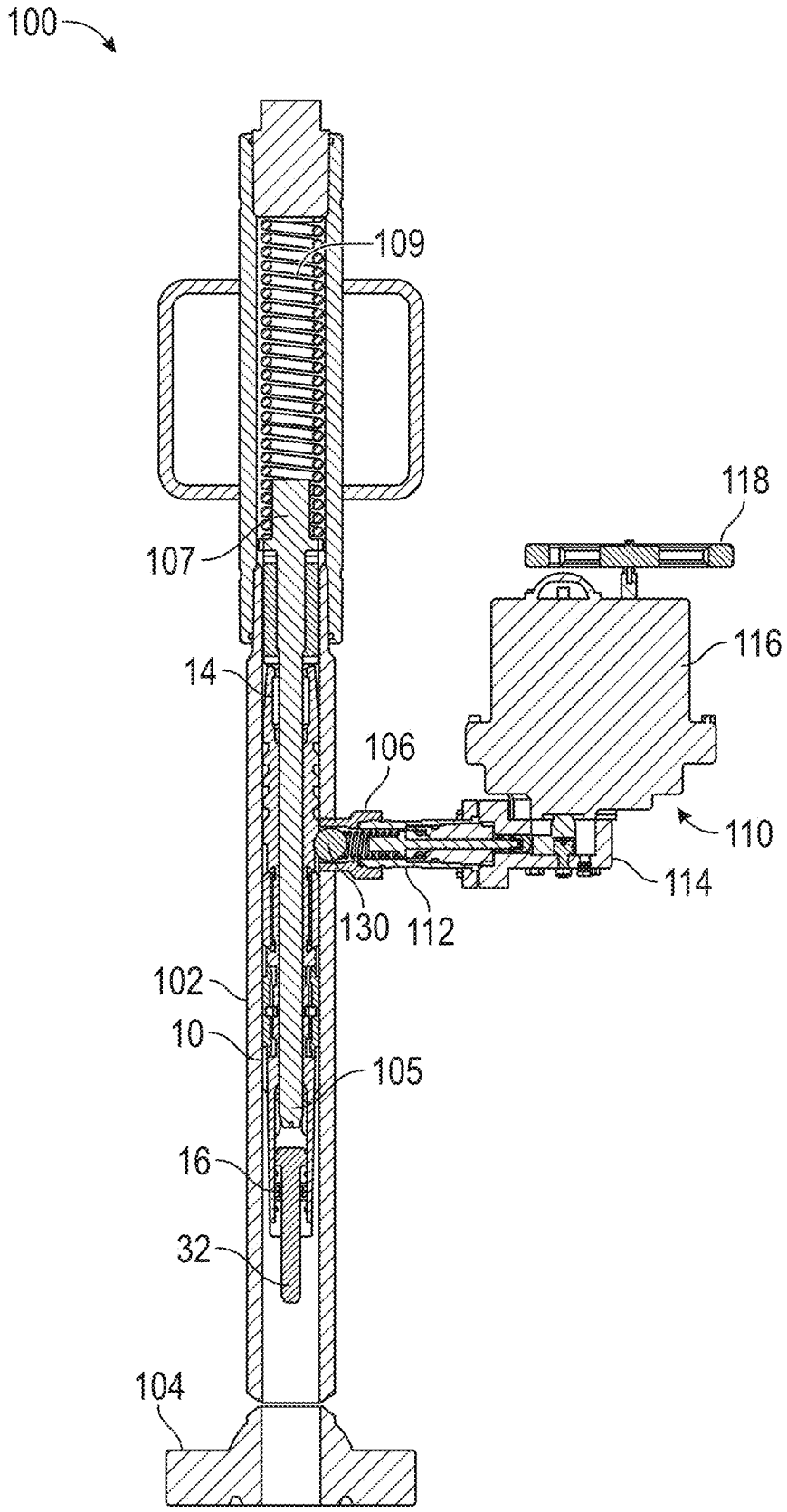
FIG. 7 is a cross-sectional view of the lubricator and catcher unit illustrated in FIG. 5 with a bypass plunger held therein.

When a bypass plunger like the one described above arrives at the top of a well bore, it is received in a lubricator having a catcher unit 100 as illustrated in FIGS. 5-7. The lubricator and catcher unit 100 is mounted atop a well bore and it includes a hollow receiving portion 102 into which the bypass plunger is received. A flange 104 at the bottom of the lubricator and catcher unit 100 attaches the lubricator and catcher unit 100 to the top of the well bore.

The lubricator and catcher unit 100 includes a receiving flange 106 that opens into the receiving portion 102. A piston housing 112 of the catcher mechanism 110 is mounted in the receiving flange 106. A lubricator unit 108 at the top of the lubricator lubricates a bypass plunger while it is temporarily held within the lubricator and catcher unit 100.

FIG. 7 is a cross-sectional view of the lubricator and catcher unit 100 with a bypass plunger 10 held in the receiving portion 102. As will be explained in greater detail below, a ball 130 of the catcher mechanism 110 is urged into the interior of the receiving portion 102 by a compression spring. When a bypass plunger 10 is pushed upward into the receiving portion 102 by fluid pressure in the well bore, the side surface of the bypass plunger 10 passes along the ball 130 until the bypass plunger is fully inserted into the receiving portion 102. When the bypass plunger is fully inserted into the receiving portion 102, the inwardly urged ball 130 holds the bypass plunger in the position illustrated in FIG. 7.

The lubricator also includes a striker bar 107 that extends downward into the center of the receiving portion 102. The striker bar 107 is movably mounted in the receiving portion 102 and can move vertically upward and downward inside the receiving portion 102. A stem at the top of the striker bar 107 is surrounded by a lower portion of a striker spring 109. The lower end of the striker spring 109 rests on an upper side of a shoulder on the stem. A lower side of that same shoulder is designed to contact the neck of a bypass plunger as the bypass plunger moves upward into the receiving portion 102.

A lower end 105 of the striker bar 107 is configured to pass through the interior bore 52 of a bypass plunger 10 as the bypass plunger 10 moves upward into the receiving portion 102. Upward movement of the bypass plunger 10 causes the lower end 105 of the striker bar 107 to contact the head of the valve dart 32 of the bypass plunger, thereby moving the valve dart 32 into the open position, where the stem of the valve dart 32 extends downward away from the lower end of the bypass plunger. As mentioned above, this allows fluid to flow through the interior of the bypass plunger so that the bypass plunger can again descend through the fluid in the well bore to the bottom of the well bore. If the bypass plunger 10 is moving rapidly upward when it arrives in the receiving portion 102, the neck 14 of the bypass plunger will hit the shoulder on the stem of the striker bar 107, and the striker bar 107 will be pushed upward against the striker spring 109. Thus, the striker spring 109 can cushion and arrest upward movement of the bypass plunger 10. In the end, the bypass plunger 102 is brought to rest in the receiving portion 102 and is held in that position by the ball 130 of the catcher mechanism 110.

In conventional catcher mechanisms, fluid pressure from the well bore itself was harnessed as a way of urging the ball 130 into engagement with the side of a bypass plunger 10. The conventional catcher mechanism included control mechanisms that used fluid pressure from the well to push the ball 130 into a catching position where the ball 130 would catch and hold a bypass plunger in the receiving portion 102, or to release pressure on the ball 130 so that the ball 130 could retract away from the side of a bypass plunger 10, thereby allowing the bypass plunger to fall downward into the well bore for a return trip to the bottom of the well bore.

While catcher mechanisms operated using fluid pressure from the well operate for their intended function, there are several drawbacks to using fluid pressure as the force to catch and release a bypass plunger.

First, the fluid pressure is typically provided in the form of pressurized gas extracted from the well bore. A catch and release cycle involves expelling some of the gas into the atmosphere when the bypass plunger is released. The emission of well gas during each catch and release cycle is potentially environmentally harmful, and well operators are seeking to minimize such gas emissions.

Also, the pressure available via well gas is variable and can decrease over time as the well reaches the end of its production life. At some point the amount of force available from well gas can fall to a level that makes it difficult to effectively catch and release a bypass plunger.

Moreover, the mechanisms used in a conventional catcher mechanism that operates based on gas pressure drawn from the well require periodic maintenance and cleaning to preserve peak operational condition.

The inventors were seeking to overcome or ameliorate the above listed drawbacks of using well pressure to operate a catcher mechanism. The inventors developed a catcher mechanism as described below, which is electrically operated via an electric motor unit 116. Components of an electrically operated catcher mechanism as described herein also can be retrofitted onto portions of an existing gas-operated catcher mechanism so that not all elements of the existing gas-operated catcher mechanism need be replaced to convert the gas-operated catcher mechanism into an electrically operated catcher mechanism.

An electrically operated catcher mechanism 110, as illustrated in FIGS. 5-7, includes a piston housing 112 that is mounted to the receiving flange 106 of a lubricator 100. An actuator assembly 114 which can include a rotatable cam is attached to the piston housing 112. A motor unit 116 with an electrically operated motor is attached to the actuator assembly 114. The motor unit 116 also includes a manual wheel 118 that can be used to manually move the ball 130 of the catcher mechanism 110 between the catch and release positions if electrical power is lost or in the event the motor unit 116 is malfunctioning.

Figure 8:
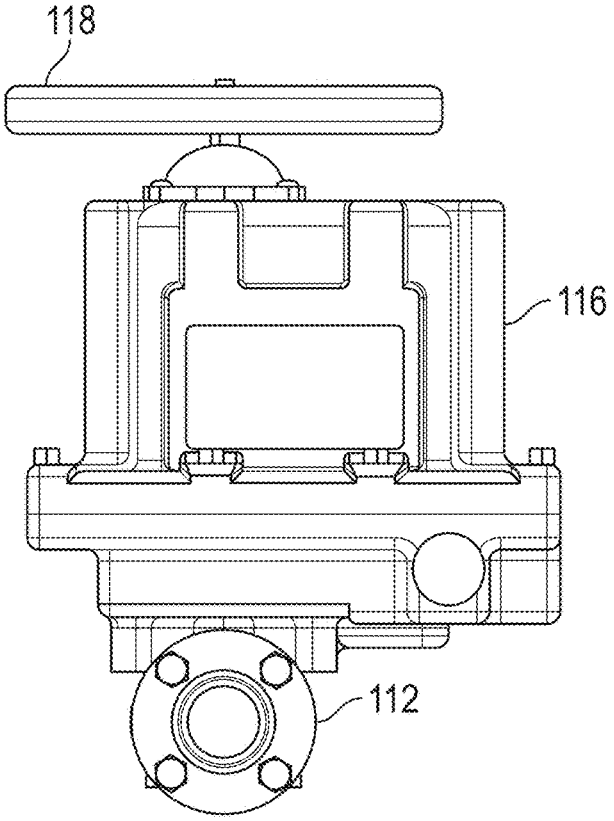
FIG. 8 is a front view of a catcher mechanism that is mountable on a lubricator and catcher unit as illustrated in FIG. 5.
Figure 9:
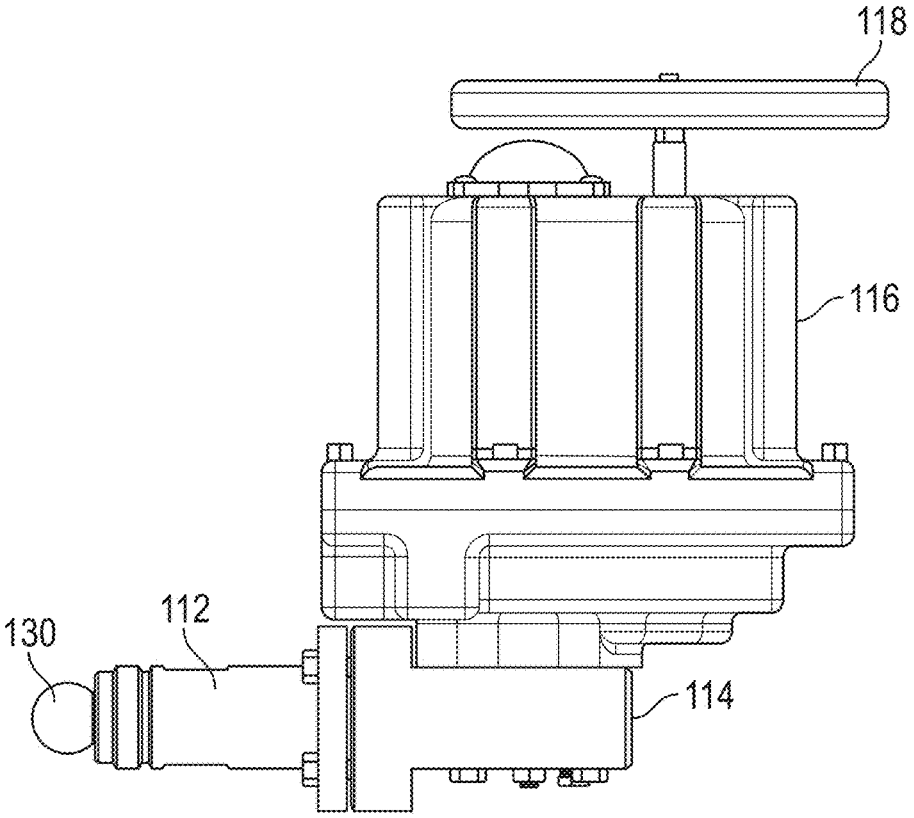
FIG. 9 is a side view of the catcher mechanism illustrated in FIG. 8.
Figure 11:
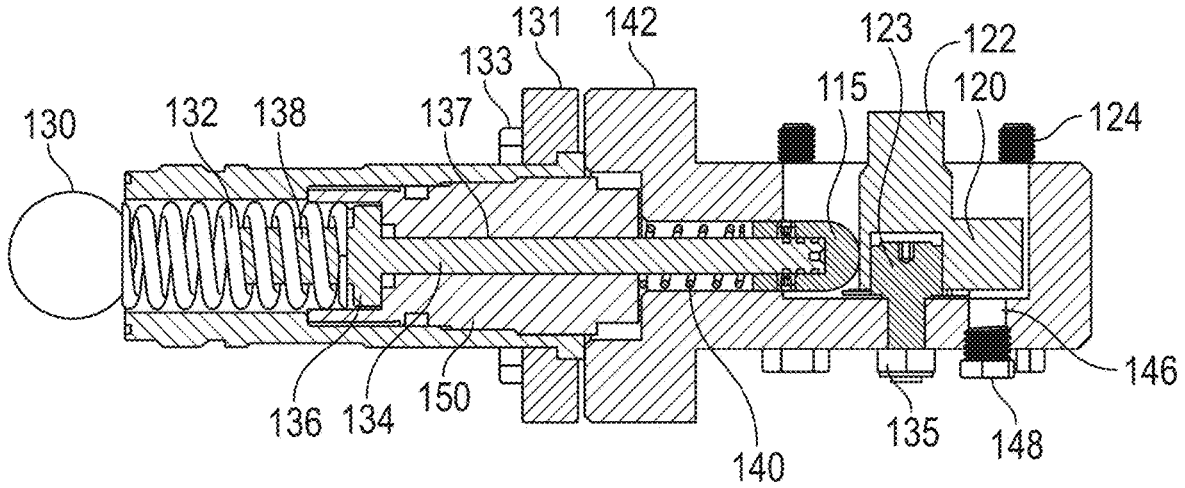
FIG. 11 is a cross-sectional view of the portion of the catcher mechanism illustrated in FIG. 10 taken along section line 11-11.

FIGS. 8 and 9 are front and side views of the catcher mechanism 110 when it is not mounted on the receiving flange 106 of the lubricator and catcher unit 100. As illustrated in these Figures, a ball 130 is located at the end of the piston housing 112. In preferred embodiments, the ball 130 is not physically attached to any portion of the catcher mechanism 110. Instead, the ball 130 is freely movable within a bore that extends inward from the receiving flange 106 into the interior of the receiving portion 102. As shown in FIG. 11, a compression spring 132 in the piston housing 112 bears against the ball 130 to urge the ball 130 inward against the side of a bypass plunger to hold the bypass plunger in the receiving portion 102.

Figure 10:
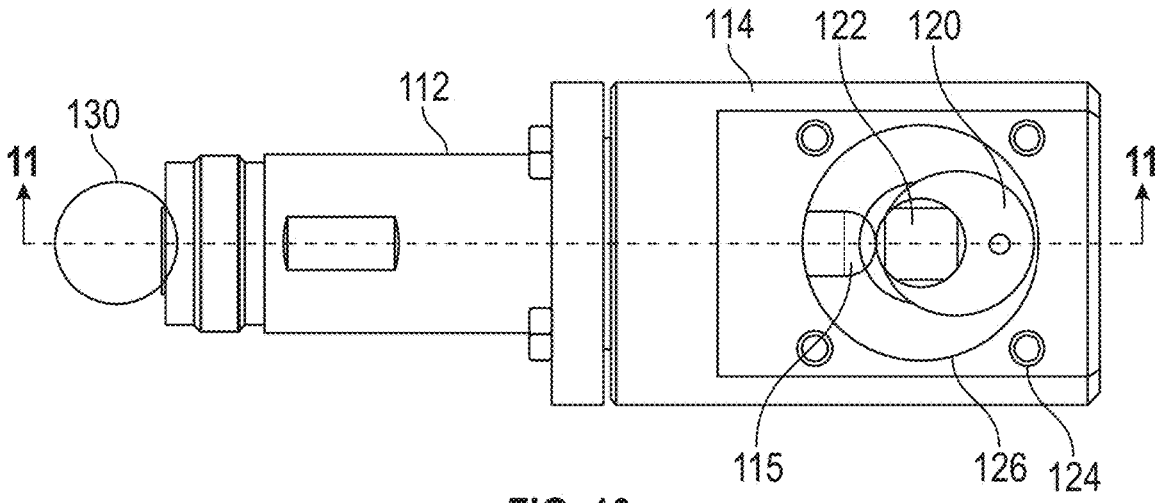
FIG. 10 is a top view of a portion of the catcher mechanism illustrated in FIGS. 8 and 9 with a motor unit removed.

FIG. 10 is a top view of the catcher mechanism 110 with the motor unit 116 removed. FIG. 11 is a cross-sectional view taken along section line 11-11 in FIG. 10. As shown in these Figures, a bearing assembly 150 is mounted in the piston housing 112. A piston 134 is slidably mounted in a piston bore 137 that extends through the bearing assembly 150. A shoulder 136 is formed on the left side of the piston 134, and a stem portion 138 of the piston 134 extends to the left of the shoulder 136. A compression spring 132 is mounted on the stem portion 138 and the right end of the compression spring 132 bears against the shoulder 136. The left end of the compression spring 132 bears against the ball 130.

The right end of the piston extends from the bearing assembly 150 into the actuator assembly 114. A follower head 115 is mounted on the right end of the piston 134. The follower head 115 bears against a rotating cam 120. A retraction spring 140 is mounted around the right end of the piston 134 and is trapped between the bearing assembly 150 and the base of the follower head 115.

A rotatable cam 120 is mounted on an axle bolt 123 that is attached to the actuator assembly 114 by a corresponding axle nut 135. A cylindrical aperture on the bottom of the cam 120 receives the top of the axle bolt 123 so that the cam 120 can rotate on the axle bolt 123. A cam nut 122 that can have a square, hexagonal or other-shaped profile that facilitates rotation of the cam 120 extends upward from the top of the cam 120. The cam nut 122 engages a corresponding structure on a motor or gearing assembly in the motor unit 116 such that the motor unit 116 can selectively rotate the cam 120 within the actuator assembly 114.

Assembly bolts 124 that pass through the body of the actuator assembly 114 can be used to attach the motor unit 116 to the top of the actuator assembly 114. Similarly, assembly bolts 133 passing though a flange 131 of the piston housing 112 can be used to couple the piston housing 112 to a flange 142 of the actuator assembly 114.

A breather passageway 146 is provided on a lower wall of the actuator assembly 114, and a breather nut 148 seals the breather passageway 146. If gas or fluid from the interior of the lubricator and catcher assembly manages to travel through the piston bore 137 into an interior of the actuator assembly 114, such fluid or gas can be removed via the breather passageway 146.

Figure 12:
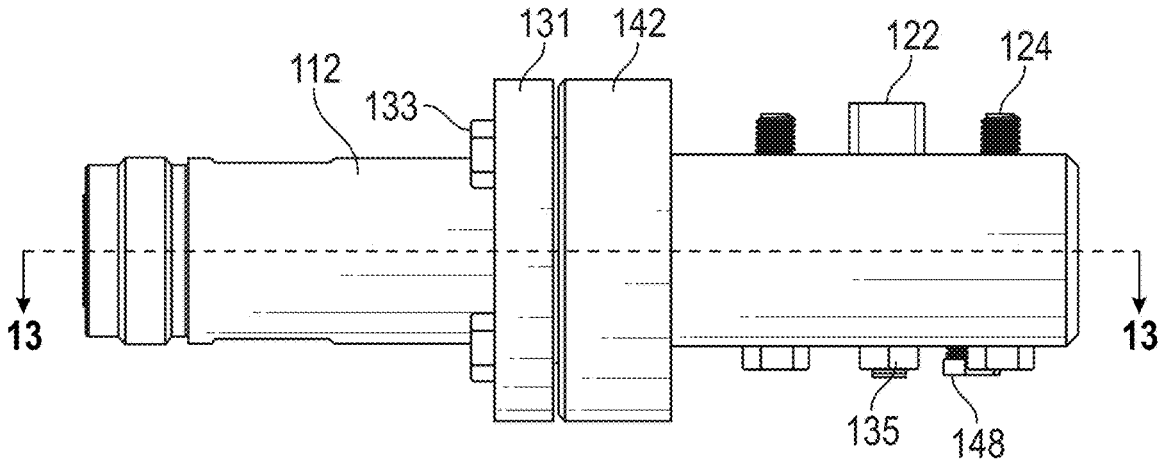
FIG. 12 is a side view of a portion of the catcher mechanism illustrated in FIGS. 8 and 9 with the motor unit removed.
Figure 13:
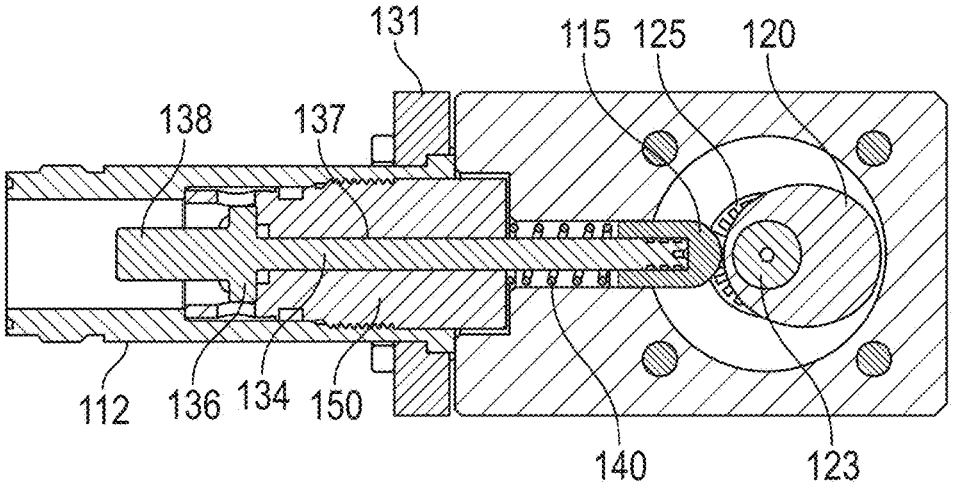
FIG. 13 is a cross-sectional view of the portion of the catcher mechanism illustrated in FIG. 12 taken along section line 13-13 where the catcher mechanism is in the release position.
Figure 14:
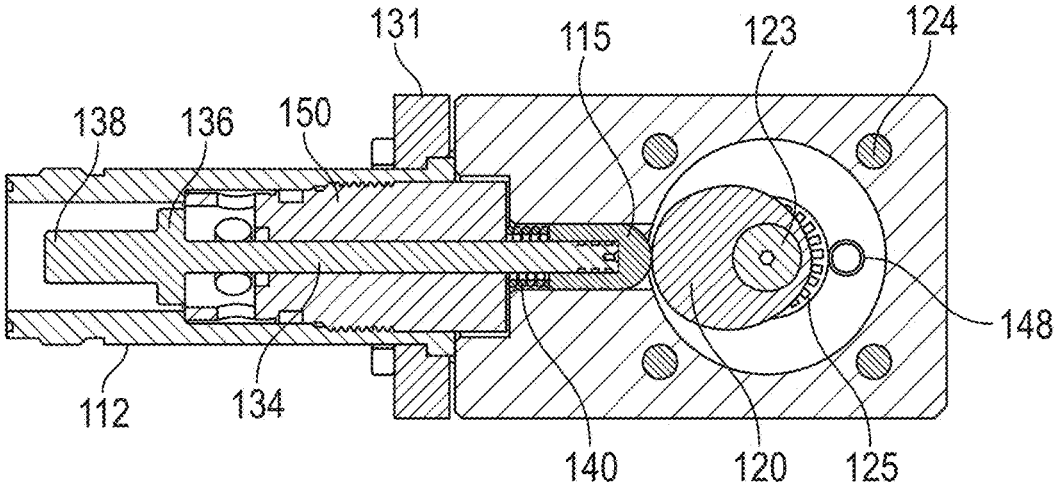
FIG. 14 is a cross-sectional view of the portion of the catcher mechanism illustrated in FIG. 12 taken along section line 13-13 where the catcher mechanism is in the catching position.

FIG. 12 provides a side view of the piston housing 112 and actuator assembly 114 without the motor unit 116. FIGS. 13 and 14 are cross-sectional views taken along section line 13-13 in FIG. 12. FIG. 13 shows the actuator assembly 114 where the piston 134 is in a release position. FIG. 14 shows the actuator assembly 114 where the piston is in a catch position.

When the catcher mechanism 110 is in a fully assembled state, an electric motor within the motor unit 116 is operatively coupled to the cam nut 122 on the top of the cam 120. A control system causes the motor to rotate the cam 120 from the release position illustrated in FIG. 13 to the catch position illustrated in FIG. 14. Rotation of the cam 120 between the release and the catch positions causes the cam 120 to push the piston 134 outward, or to the left. Outward movement of the piston 134 pushes the compression spring 132 against the ball 130 forcing the ball 130 into the receiving portion 102 of the lubricator 100. When the ball 130 is in the catch position, and a bypass plunger moves up into the receiving portion 102, the ball 130 is pushed against the side of the bypass plunger to catch and hold the bypass plunger in the receiving portion 102.

When it is time to release the bypass plunger so that it can return to the bottom of the well bore, the motor in the motor unit 116 reverse rotates the cam 120 so that the cam 120 moves from the catch position illustrated in FIG. 14 to the release position illustrated in FIG. 13. In some embodiments, instead of reverse rotating the cam 120, the cam 120 can be rotated in the same direction that caused the cam 120 to arrive at the catch position. Regardless, as the cam 120 is moved to the release position illustrated in FIG. 13 the retraction spring 140 pushes the piston 134 to the right, which retracts the end of the piston 134 upon which the compression spring 132 is mounted. This has the effect of releasing the pressure that was pushing the ball 130 into engagement with the bypass plunger so that the bypass plunger is released and can fall back into the well bore.

The controller that is used to cause the mechanism to move between the catch position and the release position can be configured to rotate the cam 120 clockwise to move the cam 120 from the catch position to the release position, and to rotate the cam 120 counterclockwise to move the cam 120 from the release position back to the catch position. This will result in wear on only one side of the cam 120. After a period of time, and after wear on the first side of the cam 120 has occurred, the control system could instead rotate the cam 120 counterclockwise to move the cam 120 from the catch position to the release position, and to rotate the cam 120 clockwise to move the cam 120 from the release position back to the catch position. This will result in the other side of the cam experiencing wear. Thus wear on the cam surfaces can be controlled by how the cam is rotated to move the cam between the catch and release positions.

The follower head 115 that is attached to the end of the piston 134 and that bears against the cam 120 can be a replaceable item that is periodically replaced as wear occurs.

The cam nut 122 of the cam 120 could be directly driven by the rotating shaft of a motor in the motor unit 116. In alternate embodiments, a gearing assembly could be provided between the rotating shaft of a motor and the cam nut 122 to cause the cam 120 to rotate at a different speed than the motor shaft and/or to provide an increased mechanical advantage.

In the example provided above, a rotating cam is used to move the piston between the catch and release positions. In other embodiments a different type of electrically operated drive mechanism could be used to move the piston between the catch and release positions. For example, a rack and pinion arrangement could be used to drive a linearly sliding cam surface. Also, a worm drive could be used in place of the rotating cam. Thus, the disclosure of a rotating cam should in no way be considered limiting.

FIGS. 15A-19B illustrate an alternate embodiment of an actuator assembly 190 that uses a cam plate assembly 170 to cause a piston of a plunger catcher mechanism to move between the catch and release positions. The alternate embodiment of the actuator assembly 190, like the actuator assembly 114 discussed above, would be attached to a piston housing via assembly bolts that pass through a flange 192 of the actuator assembly 190.

Figure 15A:
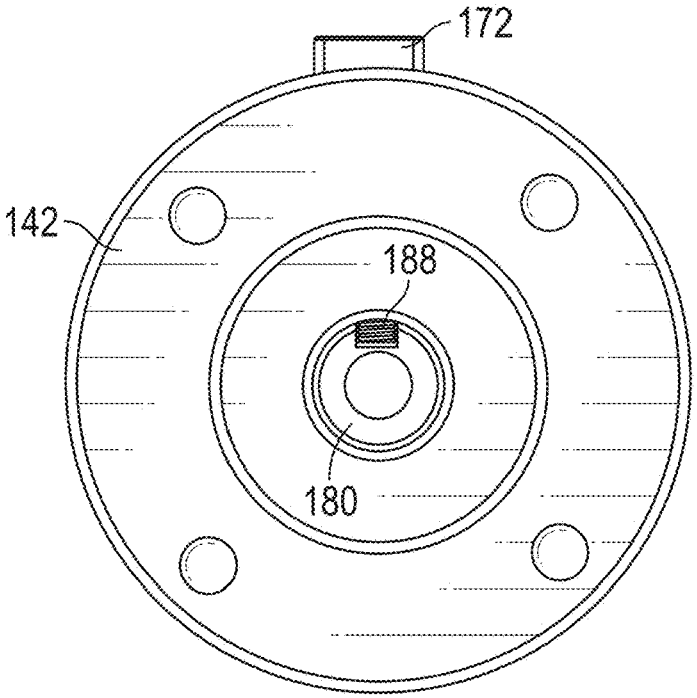
FIG. 15A is an end view of an alternate embodiment of an actuator assembly.
Figure 15B:
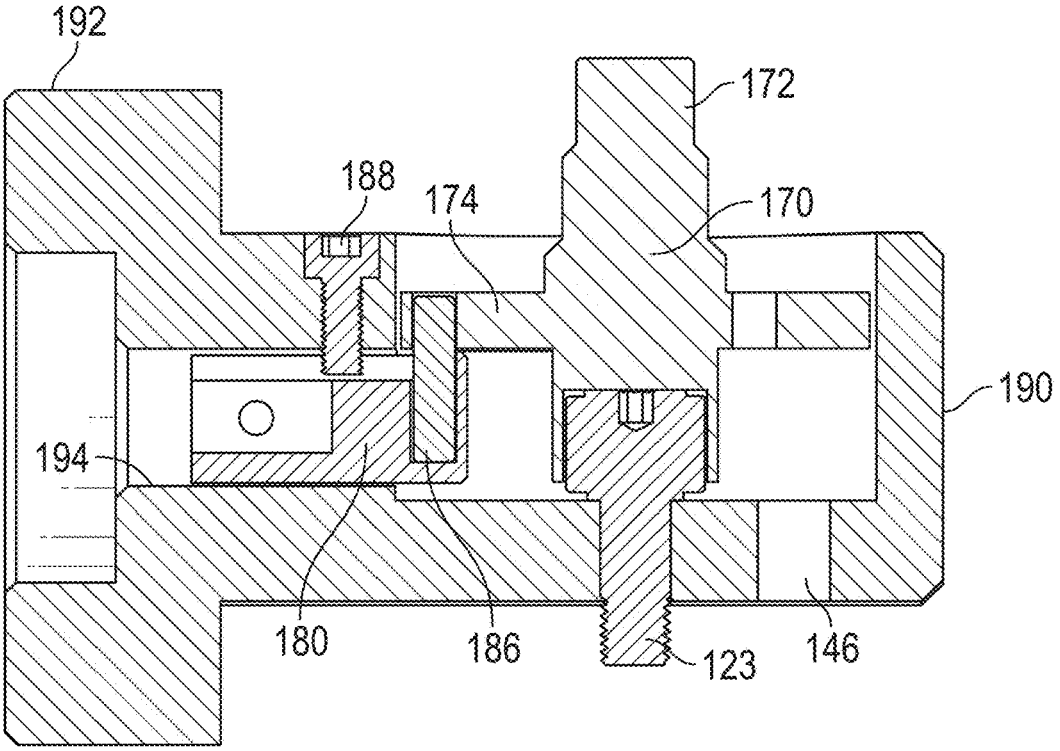
FIG. 15B is a cross-sectional view of the alternate embodiment of the actuator assembly taken along Section Line 15B-15B in FIG. 15C
Figure 15C:
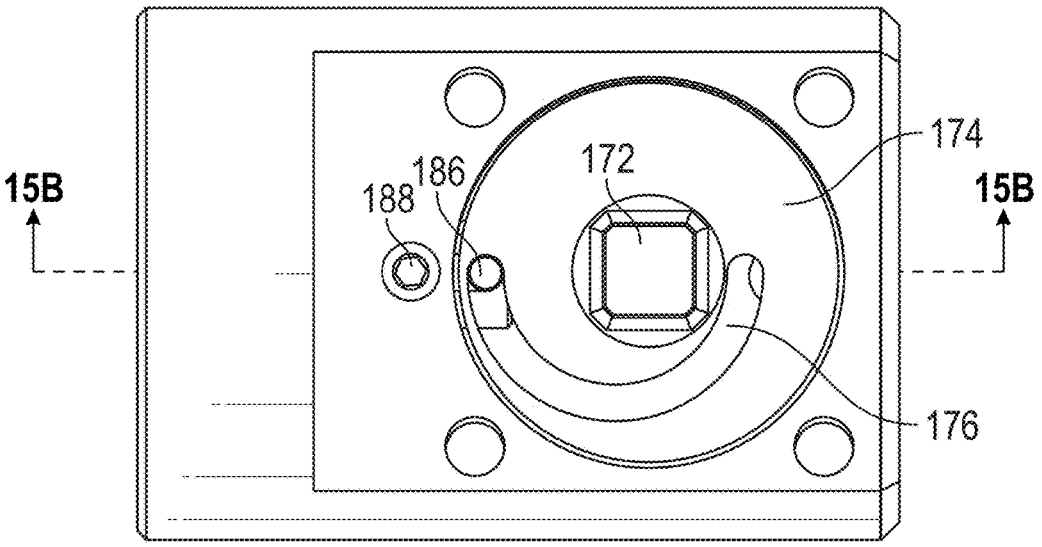
FIG. 15C is a top view of the alternate embodiment of the actuator assembly shown in FIGS. 15A and 15B.
Figure 16A:
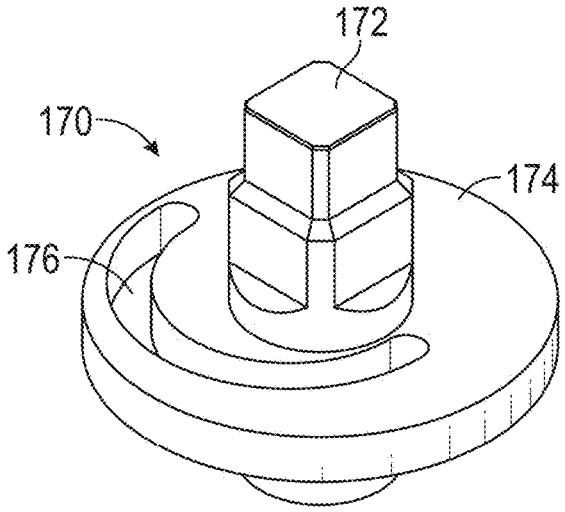
FIGS. 16A and 16B are perspective view of a cam plate assembly that is mounted in the alternate embodiment of an actuator assembly depicted in FIGS. 15A-15C.
Figure 16B:
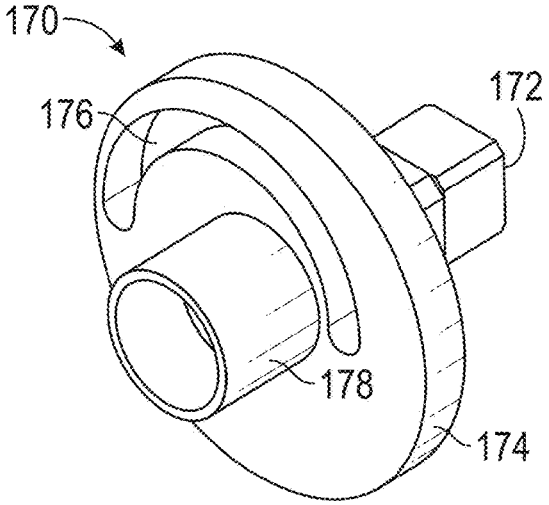
Figure 17A:
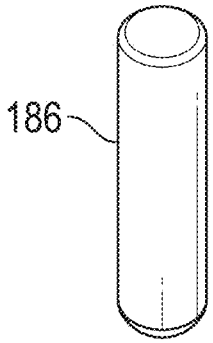
FIG. 17A is a perspective view of pin that is used to operatively couple the cam plate assembly depicted in FIGS. 16A and 16B to a stem head.
Figure 17B:
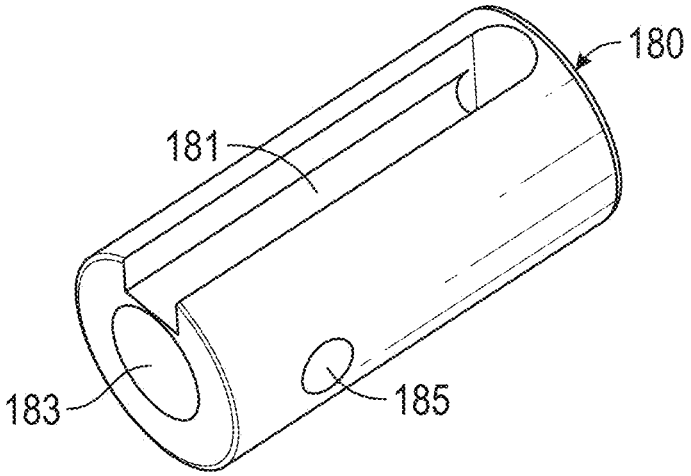
FIGS. 17B and 17C are perspective views of a stem head that is configured to operatively couple the cam plate assembly depicted in FIGS. 16A and 16B to a stem of a piston of a plunger catcher mechanism.
Figure 17C:
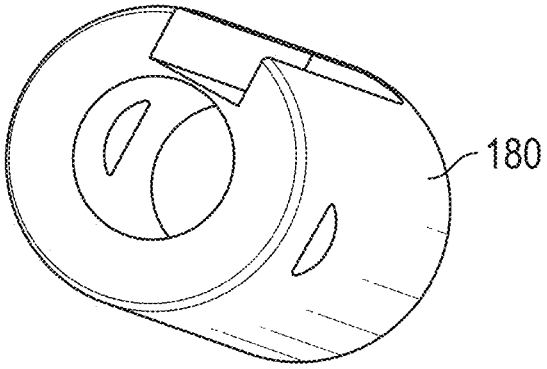

FIG. 15A is an end view of the alternate embodiment of the actuator assembly 190, and FIG. 15C is a top view thereof. FIG. 15B is a cross-sectional view of the actuator assembly 190 taken along Section Line 15B-15B in FIG. 15C. FIGS. 16A and 16B are perspective views of a cam plate assembly 170 that is mounted in the actuator assembly 190. FIGS. 17B and 17C are perspective views of a stem head 180 that would be coupled to an end of a piston 134 of the plunger catcher mechanism. FIG. 17A is a perspective view of a pin 186 that operatively couples the stem head 180 to the cam plate assembly 170.

As shown in FIGS. 15A-17C, the actuator assembly 190 includes a cam plate assembly 170 that is rotatably mounted on an axle bolt 123 fixed to the bottom of the housing. A cylindrical skirt 178 of the cam plate assembly 170 fits over the top of the axle bolt 123. A cam nut 172 on the top of the cam plate assembly 170 would be operatively coupled to the rotating shaft of a motor assembly mounted on top of the actuator assembly 190, either directly or via a gearing mechanism.

As depicted in FIG. 15B, a cylindrical stem head 180 is slidably mounted in a cylindrical bore 194 of the actuator assembly 190. a pin 186 is mounted in a pin hole 187 formed in the end of the stem head 180. The pin 186 extends upward into a cam slot 176 in a cam plate 174 of the cam plate assembly 170. The stem of a piston of the plunger catcher mechanism would be received in a stem receiving bore 183 of the stem head 180. The end of the stem of the piston would be attached to the stem head 180 via a pin or screw that is mounted in a stem attachment hole 185 that extends radially though at least one side of the cylindrical wall of the stem head 180.

As depicted in FIG. 15B, a socket head screw 188 extends down through a threaded hole in the top of the actuator assembly 170 such that the end of the end of the socket head screw 188 extends down into a slot 181 cut lengthwise down the cylindrical wall of the stem head 180. The engagement between the end of the socket head screw 188 and the slot 181 in the stem head 180 prevents the stem head from rotating around its longitudinal axis when the stem head 180 is sliding along the cylindrical bore 194 in the actuator assembly 190.

As perhaps best seen in FIG. 15C, when a motor acting on the cam nut 172 causes the cam plate assembly 170 to rotate in the clockwise direction (as seen in FIG. 15C), the top of the pin 186 will ride along the cam slot 176 in the cam plate 174. This will cause the pin 186 and the attached stem head 180 to move inward toward the axis of the cam plate assembly 170. This would have the effect of moving a piston of a plunger catcher mechanism inward towards a release position.

When the cam plate assembly is in the rotational orientation illustrated in FIG. 15C, the pin 186 is located at a first end of the cam slot 176 which positions the pin 186 and the attached stem head 180 the furthest away from the rotational axis of the cam plate assembly 170. This would position a piston attached to the stem head 180 in the catch position. Thus, the orientation of the cam plate assembly 170 illustrated in FIG. 15C corresponds to a catch orientation.

If the cam plate assembly 170 is rotated 180° clockwise from the catch orientation shown in FIG. 15C, the pin 186 would travel along the cam slot 176 until it ends up a second end of the cam slot 176. This causes the pin 186 to be located close to the rotational axis of the cam plate assembly 170. This would position a piston of a plunger catcher mechanism that is attached to the stem head 180 to be positioned in the release position. Thus, when the cam plate assembly 170 is rotated 180° clockwise from the catch orientation shown in FIG. 15C the cam plate assembly would be in the release orientation.

Figure 18A:
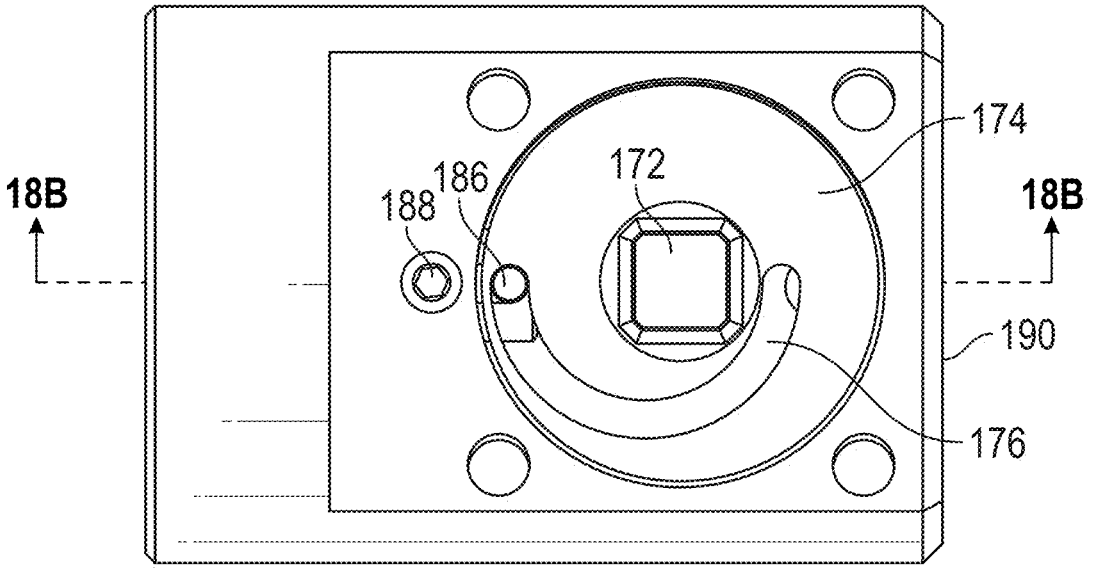
FIG. 18A is a top view of the alternate actuator assembly with the cam plate in a catch orientation.
Figure 18B:
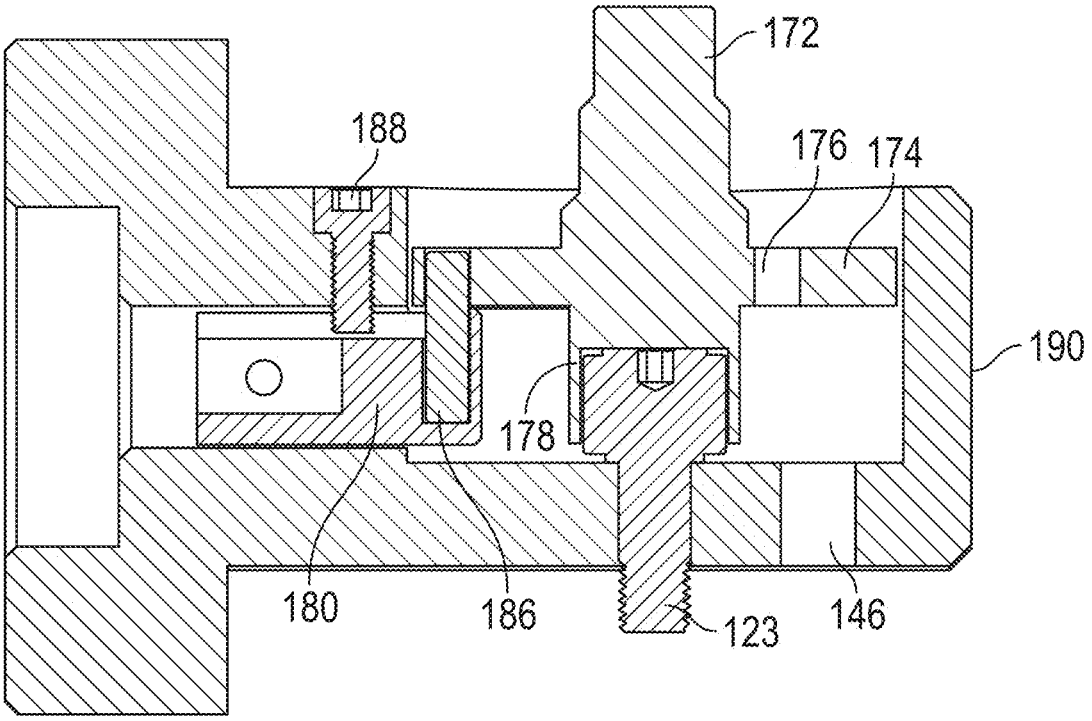
FIG. 18B is a cross-sectional view of the alternate actuator assembly depicted in FIG. 18A taken along Section Line 18A-18B in FIG. 18A.
Figure 19A:
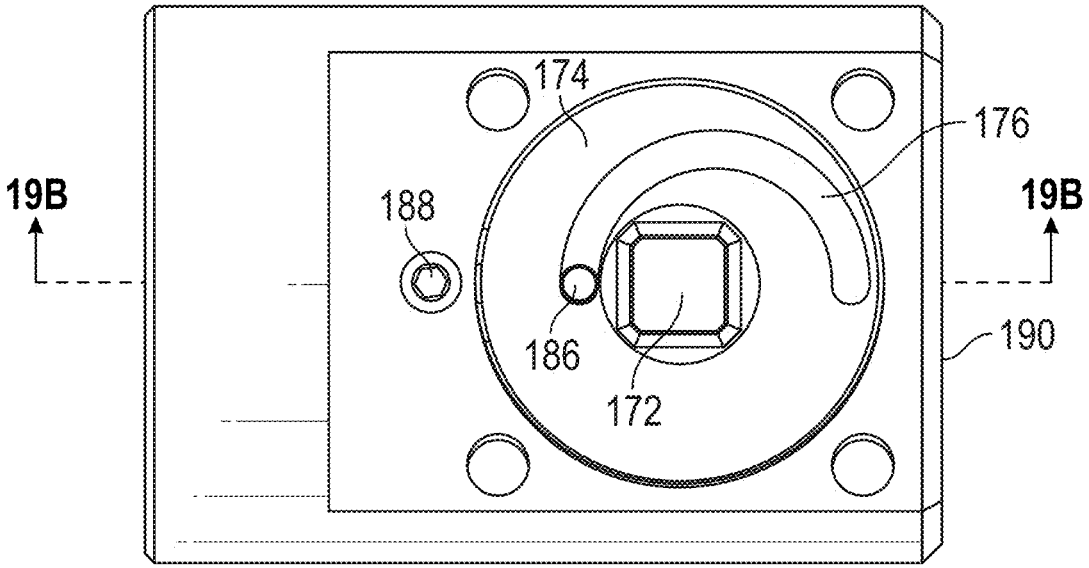
FIG. 19A is a top view of the alternate actuator assembly with the cam plate in a release orientation.
Figure 19B:
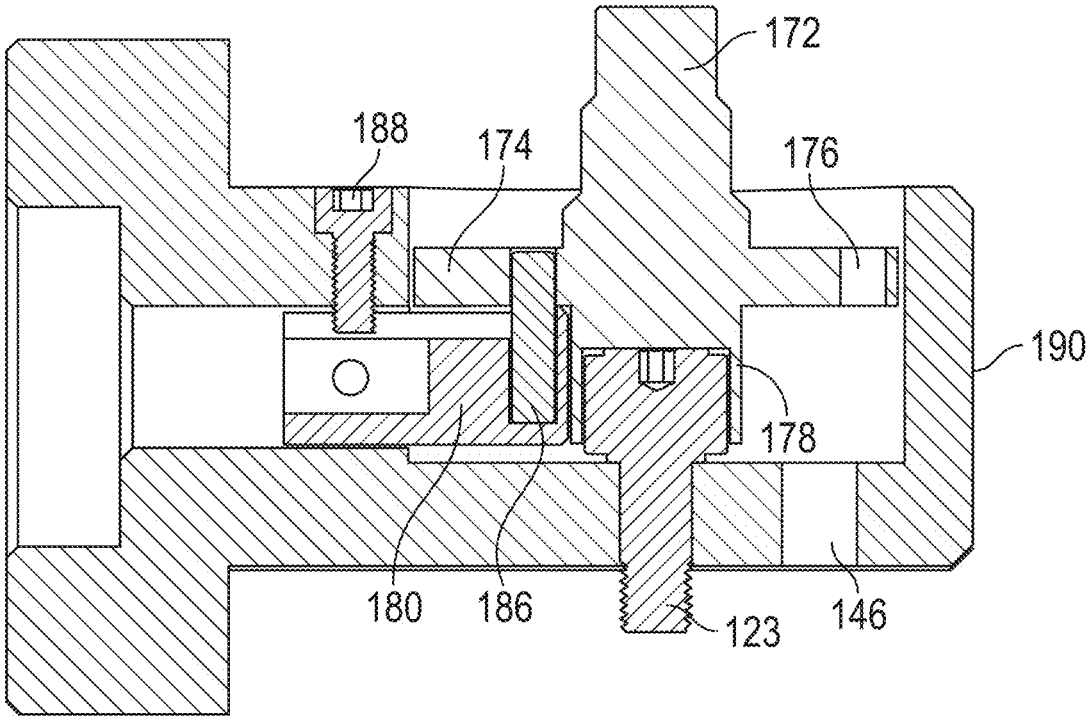
FIG. 19B is a cross-sectional view of the alternate actuator assembly depicted in FIG. 19A taken along Section Line 19A-19B in FIG. 19A.

FIGS. 18A and 18B illustrate the configuration of the actuator assembly 190 when the cam plate assembly 170 is in the catch orientation. FIGS. 19A and 19B illustrate the configuration of the actuator assembly 190 after the cam plate assembly has rotated 80° clockwise such that the cam plate assembly 170 is in the release orientation. A motor assembly mounted to the top of the actuator assembly 190 would cause the cam plate assembly 170 to rotate back and forth between those two positions. Also, a complete plunger catcher mechanism incorporating the actuator assembly 190 depicted in FIGS. 15A-19B may also include a manual mechanism, such as a manual wheel, that could be used to cause the cam plate assembly 170 to rotate between catch and release orientations.

An electrically operated catcher mechanism does not rely upon pressurized fluid to operate, and for that reason, fluctuations in the well pressure will not affect operations. Also, no gas from the well need be released into the atmosphere. If there is a power outage or a malfunction of the motor unit 116, a switch or lever can disconnect the motor in the motor unit from the drive mechanism, and the hand wheel 118 can be used to manually move the piston between the catch and release positions.

As mentioned above, an electrically operated catcher mechanism could be retrofitted onto an existing pressure operated catcher mechanism. For example, the piston housing 112 and the associated piston mechanism mounted therein could be part of an existing pressure operated catcher mechanism. The actuator assembly 114 and motor unit 116 could then be mounted onto the end of the piston housing 112 to convert the pressure operated catcher mechanism into an electrically operated one.

Conditional language, such as, "can," "could," "might," or "may," unless specifically stated otherwise, or otherwise understood within the context as used, is generally intended to convey that certain implementations could, but do not necessarily, include certain features and/or elements while other implementations may not. Thus, such conditional language generally is not intended to imply that features and/or elements are in any way required for one or more implementations or that one or more implementations necessarily include these features and/or elements. It is also intended that, unless expressly stated, the features and/or elements presented in certain implementations may be used in combination with other features and/or elements disclosed herein.

The specification and annexed drawings disclose example embodiments of the present disclosure. Detail features shown in the drawings may be enlarged herein to more clearly depict the feature. Thus, several of the drawings are not precisely to scale. Additionally, the examples illustrate various features of the disclosure, but those of ordinary skill in the art will recognize that many further combinations and permutations of the disclosed features are possible. Accordingly, various modifications may be made to the disclosure without departing from the scope or spirit thereof. Further, other embodiments may be apparent from the specification and annexed drawings, and practice of disclosed embodiments as presented herein. Examples disclosed in the specification and the annexed drawings should be considered, in all respects, as illustrative and not limiting. Although specific terms are employed herein, they are used in a generic and descriptive sense only, and not intended to the limit the present disclosure.

What is claimed is:

1. A plunger catcher mechanism configured to catch and release a plunger in a lubricator mounted to an oil or gas well, comprising:

a piston housing configured to be coupled to a lubricator mounted to an oil or gas well;

a piston assembly that is slidably mounted in the piston housing, wherein the piston assembly is configured to move in a first direction to urge a catcher element towards an internal bore of a portion of the lubricator that receives a plunger;

an actuator housing that is attached to or that is an integral part of the piston housing;

a rotatable plate that is rotatably mounted to the actuator housing and that is configured to be operatively coupled to an electric motor such that rotation of a shaft of the electric motor causes the rotatable plate to rotate;

a coupling element that operatively couples the rotatable plate to the piston assembly such that rotation of the rotatable plate in a first rotational direction causes the piston assembly to move in at least the first direction; and a rotation prevention mechanism that allows the piston assembly to translate along the piston housing and that prevents the piston assembly from rotating with respect to the piston housing, the rotation prevention mechanism including a slot provided on one of an external surface of the piston assembly and the piston housing and a projection on the other of the external surface of the piston assembly and the piston housing, wherein the projection on the piston housing is received in the slot.

2. The plunger catcher mechanism of claim 1, further comprising a return spring mounted to the piston housing and operatively coupled to the piston assembly such that the return spring biases the piston assembly to move in a second direction that is opposite the first direction.

3. The plunger catcher mechanism of claim 1, further comprising an electric motor mounted to the actuator housing and operatively coupled to the rotatable plate such that rotation of a shaft of the electric motor causes the piston assembly to move in at least the first direction.

4. The plunger catcher mechanism of claim 3, further comprising a gearing mechanism that operatively couples the shaft of the electric motor to the rotatable plate.

5. The plunger catcher mechanism of claim 1, wherein the rotatable plate and the piston assembly are operatively coupled such that rotation of the rotatable plate in a second rotational direction opposite the first rotational direction causes the piston to move in a second direction that is opposite the first direction, wherein movement of the piston assembly in the second direction results in the piston assembly urging the catcher element away from the internal bore of a portion of the lubricator that receives a plunger.

6. The plunger catcher mechanism of claim 1, wherein movement of the piston assembly in the first direction moves the piston assembly toward a catch position, and wherein movement of the piston assembly in a second direction opposite the first direction moves the piston assembly away from the catch position toward a release position.

7. The plunger catcher mechanism of claim 6, rotation of the rotatable plate in the first rotational direction causes the piston assembly to move toward the catch position, and wherein rotation of the rotatable plate in a second rotational direction opposite the first rotational direction causes the piston assembly to move toward the release position.

8. The plunger catcher mechanism of claim 1, further comprising a catcher spring mounted in the piston housing and operatively coupled to an end of the piston assembly and the catcher element, wherein when the piston assembly moves in the first direction, the catcher spring is configured to urge the catcher element towards the internal bore of the portion of the lubricator that receives a plunger.

9. The plunger catcher mechanism of claim 1, wherein the coupling element comprises a pin that extends between the rotatable plate and the piston assembly.

10. The plunger catcher mechanism of claim 9, wherein the pin extends from an end of the piston assembly adjacent the rotatable plate, and wherein a distal end of the pin is slidably mounted in a cam slot of the rotatable plate.

11. An actuator for a plunger catcher mechanism used to catch and release a plunger in a lubricator mounted to an oil or gas well, comprising:

an actuator housing;

a piston housing that is mounted to or which is a part of the actuator housing;

a piston assembly that is slidably mounted in the piston housing so that it can move between a catch position and a release position;

a rotatable plate that is rotatably mounted to the actuator housing, wherein the rotatable plate is operatively coupled to the piston assembly such that rotation of the rotatable plate in a first rotational direction causes the piston assembly to move toward the catch position; and a coupling mechanism that couples the rotatable plate to the piston assembly, wherein the coupling mechanism comprises a pin that extends between the rotatable plate and the piston assembly, wherein when the rotatable plate rotates, it causes the pin to slide in a slot provided in one of the rotatable plate and the piston assembly.

12. The actuator of claim 11, further comprising a motor mounted to the actuator housing and having a rotating shaft that is operatively coupled to the rotatable plate such that rotation of the rotating shaft causes the rotatable plate to rotate.

13. The actuator of claim 12, further comprising a gearing mechanism that operatively couples the rotating shaft of the motor to the rotatable plate.

14. The actuator of claim 12, further comprising a controller that is operatively coupled to the motor and that is configured to selectively cause the motor to drive the piston assembly between the catch position and the release position.

15. The actuator of claim 11, wherein rotation of the rotatable plate in a second rotational direction that is opposite to the first rotational direction causes the piston assembly to move toward the release position.

16. The actuator of claim 11, further comprising a return spring mounted within the piston housing or the actuator housing, the return spring being operatively coupled to the piston assembly such that the return spring biases the piston assembly toward the release position.

* * * * *